United States Patent [19]

Hultgren

[11] Patent Number: 4,516,562

[45] Date of Patent: May 14, 1985

[54] ARRANGEMENT IN COMBUSTION CHAMBERS FOR BURNING SOLID FUEL

[76] Inventor: Karl S. H. Hultgren, Rosengården, Kyrkv. 18, S-565 00 Mullsjö, Sweden

[21] Appl. No.: 485,115

[22] PCT Filed: Jul. 21, 1982

[86] PCT No.: PCT/SE82/00248

§ 371 Date: Mar. 1, 1983

§ 102(e) Date: Mar. 1, 1983

[87] PCT Pub. No.: WO83/00373

PCT Pub. Date: Feb. 3, 1983

[30] Foreign Application Priority Data

Jul. 23, 1981 [SE] Sweden ..... 8104516 3

[51] Int. Cl.[3] ..... F24C 1/14

[52] U.S. Cl. ..... 126/77; 126/79; 126/112

[58] Field of Search ..... 431/115; 126/74, 10, 126/68, 73, 77, 108, 255, 146, 112, 79; 110/300, 309, 310, 314, 204, 205

[56] References Cited

U.S. PATENT DOCUMENTS

| | | | |
|---|---|---|---|
| 20,274 | 5/1858 | Henderson | 126/77 |
| 80,935 | 8/1868 | Eilley | 126/77 |
| 163,583 | 5/1875 | Doyle | 126/77 |
| 471,038 | 3/1892 | Trecy | 126/108 |
| 516,017 | 3/1894 | La Rue | 126/146 X |
| 569,473 | 10/1896 | Ringland | 126/112 |
| 691,398 | 1/1902 | Macy | 110/207 |
| 764,334 | 7/1904 | Banks | 126/77 |
| 823,962 | 6/1906 | McLeod | 110/205 |
| 837,320 | 12/1906 | Menkey | 126/79 |
| 1,564,866 | 12/1925 | Leslie | 431/115 |
| 1,685,339 | 9/1928 | Randolph | 110/313 |
| 1,729,151 | 9/1929 | Brunner | 110/309 |
| 1,738,881 | 12/1929 | Frenier | 431/115 |
| 2,411,324 | 11/1946 | Gagnon | 110/322 |
| 3,286,666 | 11/1966 | Ohlsson | 110/264 |

FOREIGN PATENT DOCUMENTS

| | | |
|---|---|---|
| 122337 | 6/1900 | Fed. Rep. of Germany . |
| 1125858 | 11/1956 | France . |

*Primary Examiner*—Samuel Scott
*Assistant Examiner*—Noah Kamen
*Attorney, Agent, or Firm*—Pennie & Edmonds

[57] ABSTRACT

A solid fuel combustion chamber having fire bars supporting the fuel and two screening walls located above the fire bars, one screening wall overlying the other having an inlet opening larger that and communicating with the outlet of the underlying screening wall.

8 Claims, 4 Drawing Figures

ARRANGEMENT IN COMBUSTION CHAMBERS FOR BURNING SOLID FUEL

BACKGROUND OF THE INVENTION

The present invention relates to an arrangement in combustion chambers for burning solid fuel, such as firewood, wood chips, pellets, coal and sundry waste, by recirculation combustion, and including a combustion chamber with its lower section provided with fire bars, a convection section, a flue gas outlet and a fan for optionally supplying an air or an air and flue gas mixture.

For both domestic boilers and large boilers or furnaces, the most pure flue gases possible and as small amounts of excess air as possible are sought for during combustion. Since extra purification equipment is expensive, the flue gases from the boiler should furthermore be so pure that it is not necessary to use any such extra equipment. The desired slight excess of air causes a minor gas flow through the boiler, which signifies a reduction of the pressure drop in the convection section to a minimum. This advantageously affects running costs and also decreases the capacity requirement of the fan. With slight excess air there is also obtained a higher flame temperature, which is advantageous with regard to the transmission of energy in the boiler.

In the firing techniques applied up to now for firing with solid fuel, it has been found difficult to keep the amount of excess air small. According to a recently published Swedish investigation it has been found that the excess air varied between 400 and 500 percent for normal firing and loading conditions. It is obvious that in such cases the firing economy will be very poor and that the amount of pollutants in the flue gases is large. This has also been found by the investigation. Since the highest flame temperature should be about at least 1000° C. in the primary zone of a flame, and rapidly taper off towards the outer portions of the flame, a very large proportion of the air will namely only pass between the flame and the walls of the combustion chamber without participating in combustion and with the result that instead it cools both the flame itself and the combustion gases.

It is known that improved combustion in firing with fuel oil as well as with solid fuel is achieved by recirculating a portion of the used gases back to the primary zone of the flame. The recirculated flue gases can either be mixed with fresh air outside the boiler or also directly inside the combustion chamber.

In a heavy reduction of the excess air, the possibility is also reduced for the formation of oxygen-rich sulphur and nitrogen compounds such as $SO_3$ etc. There are also indications that the excess air is directly proportional to the so-called POM-formations, i.e. all the probable cancer-developing substances included in the designation "polyaromatic hydrocarbons" (POM). If the oxygen excess, i.e. the air excess, can be reduced to an absolute minimum during combustion, the POM quantities should thus also be small.

A prerequisite for reducing the soot emission in the flue gases is that the mean flame temperature is kept very high, at least 1000° C., and preferably higher. If the whole of the temperature increases is to take place within a single zone, it must be rapid and require very high temperatures within the gasification zone of the fuel, which leads to the production of fly ash. This results in damaging effects both with regard to the final composition of the flue gases and with regard to the fact that fly ash is very corrosive to metals, with all the problems this implies.

Three different phases may thus be distinguished in the combustion sequence, with regard to achieving high efficiency and a high degree of purity in the emitted combustion gases at the same time. In the first of these phases the fuel will be quickly gasified at a temperature lower than the melting point of the ash, i.e. lower than 1000° C., in the second the gas will be burned as rapidly and effectively as possible with low excess air and the third phase will comprise burning fuel residues and combustible gas residues, which is particularly applicable with so-called long-flame fuels.

SUMMARY OF THE INVENTION

The present invention has the object of providing a new and improved arrangement starting with an arrangement in combustion chambers of the kind set forth in the introduction, said arrangement surmounting the mentioned drawbacks with the known technology and allowing combustion of solid fuel with the help of recirculated flue gases in a so-called "blue flame". The arrangement will also be adaptable to different types of solid fuel with varying energy content and varying combustion properties. External and/or internal recirculation will be utilizable in the arrangement. Furthermore, the natural draught in the chimney associated with the hearth will also be utilizable for conveying the fresh air and/or mixture of fresh air and residue gases required for combustion in the arrangement.

Tests carried out with different embodiments in apparatus made in accordance with the invention have shown that this object has been achieved primarily as a result of an arrangement in accordance with the invention being distinguished by it also including a first supply conduit from the pressure side of the fan having its outlet situated in a pressure chamber under the fire bars of the combustion chamber, a second supply conduit from the pressure side of the fan to the combustion chamber, with its outlet arranged above the fire bars and having the form of a gap partially or completely surrounding the fire in the combustion chamber, and a possible return conduit to the suction side of the fan for recirculating flue gases from the outlet of the flue gas conduit associated with the combustion chamber.

In the tests carried out with the arrangements in accordance with the invention, it has even been found possible, with the aid of externally recirculated gas, to achieve practically soot-free gases for all the solid fuels tried, within a very large loading range and with practically stoichiometric values for the excess of air. Instead of excess air of about 300–400%, as in the previously known apparatus, excess air of about 5–10% was obtained with the new and improved arrangements. By raising the flame temperature the catalytic action of the residue products in the flue gases on the combustion rate has increased considerably, resulting in that cracking, i.e. the formation of carbon flakes of free carbon (soot) does not have time to occur to the same extent as with the previously known apparatus. A blue flame is obtained in combustion, as with oil firing, which is characteristic for gas combustion, i.e. the type of combustion desired and giving the desired advantages. The proportion of blue flames has been found to vary within rather wide limits, namely between 25 and 100%, without the purity of the flue gases being essentially altered.

Neither were the small excess air values altered to any essential extent, and in some cases an intensively concentrated blue flame in the shape of a narrow standing pillar was obtained during the trials.

In firing with coal or other energy-rich solid fuels, a portion of the fresh air or fresh air-flue gas mixture to the combustion chamber can be suitably used for effectively cooling the fire bars from within, since the exterior cooling of them would sometimes appear to be insufficient. The fire bars should therefore be made hollow so that fresh air or air-flue gas mixture or at least some portion thereof can be taken from the fan through the fire bars subsequently to flow out through the fuel bed in the combustion chamber.

In a particularly advantageous embodiment of an arrangement in accordance with the invention, the combustion chamber includes an upwardly open first screening wall surrounding the fire and situated above the fire bars, there being a second screening wall situated above the first one, the upper periphery of the lower wall being less than the lower periphery of the upper wall to form the gap around the fire in the combustion chamber. A portion of the fresh air and/or air-flue gas mixture from the fan passes through this gap between both screening walls. The screening walls may have different implementation and either be round or with corners, with a shape primarily adjusted to the fuel. The upper screening wall is to advantage downwardly joined to a horizontal wall in the combustion chamber, this wall forcing all gas (air or air-flue gas mixture) not passing on the inside of the lower screening wall to pass through the gap and into the third and last combustion zone. Since the cross sectional area of the gap can be made small, the flow rate through the gap is high, having the result that the static pressure in the gap is low, and the static pressure difference obtained between the pressure in the space inward of the screening walls and the pressure in the gas stream in the vicinity of the gap, creates a recirculation zone inside the upper of both screening walls and immediately above the gap. As a result of this, the fresh air and/or air-flue gas mixture flowing in through the gap will be mixed with the combustible residue gases occurring during combustion in the second and third combustion zones, whereby the conditions for blue or pure gas combustion are achieved with fuels other than gas and oil also.

In the trials with apparatus made in accordance with the invention, it has also been found ideal that solely the combustion required to provide the quantity of energy and temperature necessary for gasifying the fuel takes place in the combustion zone directly above the fire bars.

As a result of creating the conditions for good combustion, the fresh air and/or air-flue gas mixture flowing through the gap also has the task of providing so-called "skin cooling" on the inside of the upper screening wall to keep its temperature at a level suitable to the wall material, e.g. at about 700° C. when using ordinary carbon steel for the wall.

If a suitable mixture of fresh air and flue gases is supplied through the fire bars to the interior of the lower screening wall and to the gap between both screening walls arranged one above the other, there is obtained a combination of an external and an internal recirculation. On the other hand, if only fresh air is supplied, only the latter form of recirculation occurs. The differences in measured purities for the departing flue gases or for $CO_2$ contents have been found to be small in these cases however, but with somewhat better values for the first case, which could also be expected. The latter alternative is considerably simpler in its construction, however, and particularly suitable when electricity is not available for a fan, and the natural draught from the chimney is the only means of providing the necessary air supply to the fuel chamber. Fuel can either be supplied by hand through a filling hatch or supplied by means of a screw, piston or the like. The rate of feed can then suitably be controlled by a relay, e.g. one sensing the water temperature in the convection section of the boiler.

Valves and/or other control means should be arranged in the fresh air intake of the fan, in the flue gas conduit and in the secondary air supply conduit, if such is used. By means of these valves, which may be simple pivoting flaps, the fuel chamber arrangement in accordance with the invention may be simply controlled for optimum combustion with a blue flame for all conceivable solid fuels.

Above the fire bars there is suitably placed a fine mesh grating of expanded metal or the like, to prevent fuel of a minor lump size falling through the fire bars. Simultaneously there is obtaind a more uniform distribution of the air and/or air-flue gas mixture flowing through.

BRIEF DESCRIPTION OF THE DRAWINGS

Further advantages and characterizing features of the invention will be apparent from the following detailed description, which is made in conjunction with the appended drawings, on which

DESCRIPTION OF PREFERRED EMBODIMENTS

Figure 1:
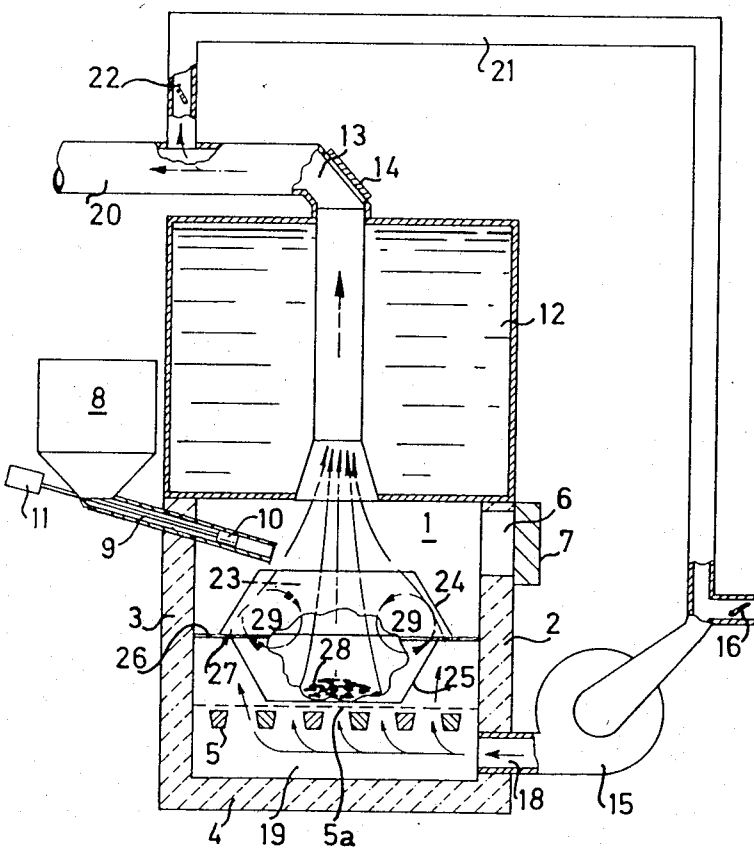
FIG. 1 illustrates a first embodiment of a combustion chamber arrangement in accordance with the invention with the supply of a mixture of air and flue gases.
Figure 4:
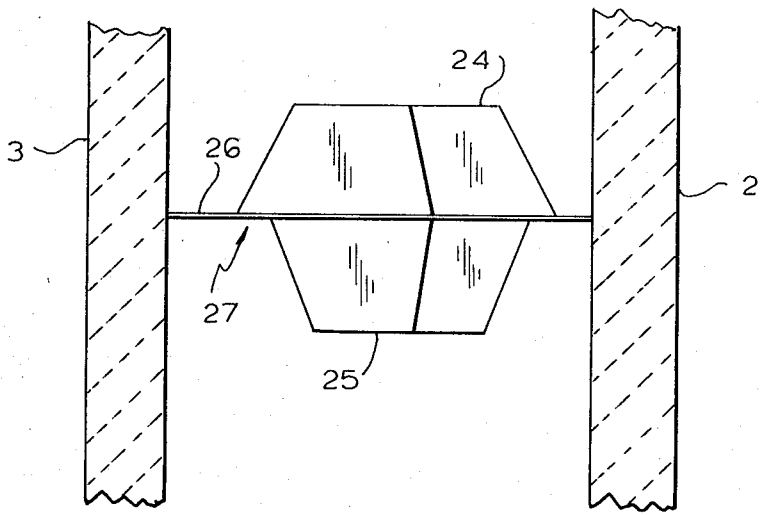
FIG. 4 is a simplified vertical section of an arrangement that includes screening walls in the shape of truncated pyramids.
Figure 3:
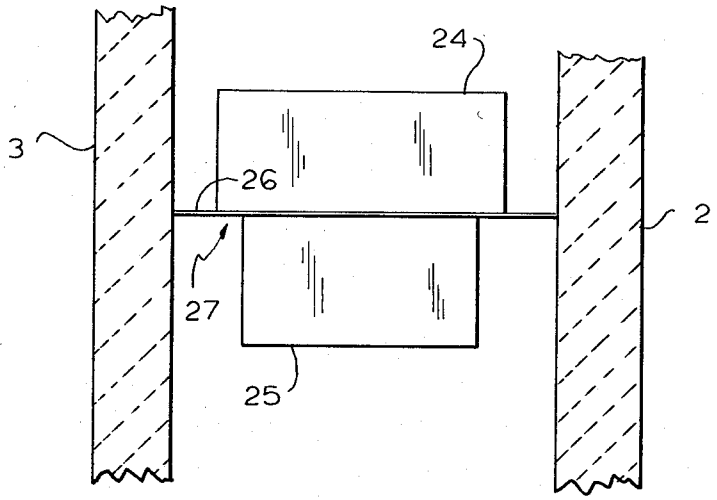
FIG. 3 is a simplified vertical section of an arrangement that includes cylindrical screening walls.

In the first embodiment of an arrangement in accordance with the invention illustrated in FIG. 1, there is arranged in the lower section of a boiler a combustion chamber 1, provided with fire bars 5, and also with walls 2,3 and bottom 4, these being preferably of refractory material. This combustion chamber can either be water-cooled or provided with thick insulating walls so that heat losses will be small. Water cooling may also be possibly combined with thick insulating walls. Such walls by themselves are however to be preferred, since cold surfaces can have disastrous effects on combustion in general and in particular on so-called "blue combustion" with recirculation. The fire bars 5 may possibly be covered by a network 5a of fine-mesh expanded metal or the like, to enable combustion of particulate fuel having minor particle size.

Above the fire bars 5 there is a filling opening 6 in the wall 2, and a hatch 7 for closing this opening. Fuel supply can suitably be by a gravity feed stoker including a fuel container 8, a delivery pipe 9 or the like, and a feed piston 10 or the like, driven by a motor 11. This motor is suitably controlled by a relay in response to the water temperature in the boiler convection section. In firing with a stoker of this kind, the fuel chamber volume may be kept relatively small.

In the upper section of the boiler, and thus above the combustion chamber 1 there is a convection section 12 for recovering the energy in the flue gases, and uppermost there is a flue gas outlet 13 for leading away the flue gases. This outlet is suitably provided with a cleaning and inspection cover 14.

Fresh air is obtained by means of a fan 15, which draws in air through an inlet conduit 17 and blows air through a supply conduit 18 into the combustion chamber 1. More specifically, the supply conduit 18 opens out under the fire bars 5 in a distribution space 19 simultaneously functioning as an ash chamber. A return conduit 21 for a portion of the flue gases is arranged between the suction side of the fan 15 and a flue gas conduit 20 connected to the flue gas outlet 13. A valve 22 is mounted in this return conduit for regulating the flue gas flow to the fan. By means of this valve 22 and the valve 16 in the inlet conduit 17 for fresh air, a mixture of fresh air and flue gas with the desired composition can be supplied to the combustion chamber 1 with the aid of the fan 15. It will be understood from the preceding that the mixture of fresh air and recirculated flue gases passes through the supply conduit 18 and into the distribution space 19, continuing from there up through the fire bars 5. After having passed the latter the major portion of this gas mixture flows up through the fuel bed 28 lying on the fire bars, said bed being situated, in accordance with the invention, inside the lower porton of a first annular screening wall 25, preferably with the shape of the curved surface of a truncated cone with its smaller diameter downwards. A certain reduction thus occurs simultaneously as the fuel is gasified at a temperature lower than 1000° C., whereupon the combustible gas mixture thus formed is combusted inside the space 23 defined by said first annular screening wall 25 containing the fuel bed 28, and a second annular screening wall 24 mounted above the first one in accordance with the invention, said second wall 24 also preferably haing the shape of a curved surface of a truncated cone, and having its base facing downwards towards the upwardly facing base of the first screening wall 25. Since the base diameter of the first screening wall 25 is less than that of the second one 25 placed above it, and both screening walls are concentric, there is in accordance with the invention an annular gap 27 between their opposing ends. Through this gap there passes simultaneously the remaining portion of the mixture of fresh air and recirculated flue gases coming from the supply conduit 18, and via distribution space 19 and fire bars 5 into the combustion space 23 inside both annular screening walls 24,25, after having first passed along the outside of the lower one 25. In accordance with the invention, no other flow possibility is allowed this gas mixture portion, since a horizontal closed-off intermediate wall 26 is arranged between the bottom edge of the upper annular wall 24 and the surrounding combustion chamber walls 2,3, such that only the annular gap 27 between both these screening walls is open for the portion of the gas mixture coming from the distribution space 19 and not passing through the fuel bed 28. In the combustion space 23 the portion of the air-flue gas mixture coming through the gap 27 between both screening walls 24,25 is mixed with the combustible gas mixture rising up in the lower annular screening wall 25, the mixture taking place in the final combustion zone of the hearth, which begins in the middle of the combustion space 23 and at least substantially terminates in the upper portion of the upper annular screening wall 25.

When the portion of the mixture of fresh air and recirculated flue gases coming through the annular gap 27 is subjected to a heavy decrease in area, its flow rate will become high, which is also otherwise partly due to the temperature increase in the gas mass. The rate increase causes the static pressure to decrease to a corresponding degree, whereby a gas flow, indicated by the arrows 29 in the upper of the two annular screening walls, is formed to provide the previously mentioned effect. The terminally combusted gases rise, due to the draught in the chimney, and leave the greater portion of their heat energy in the convection section 12, and finally pass out through the flue gas outlet to the chimney.

In the embodiment now described, the combustion space for an arrangement in accordance with the invention has been described as including two annular screening walls having the shape of the curved surfaces of two truncated cones with different base diameters, said curved surfaces being arranged with their bases opposing. This embodiment is namely particularly advantageous. However, it is to be understood that both screening walls can also have the shape of the sloping surfaces of two similarly arranged truncated pyramids. They may even have cylindrical or polygon shape, whereby the upper one must naturally be given a larger cross section than the lower one for a gap to be formed between them.

In trials with the arrangement in accordance with the invention, illustrated in FIG. 1 and described above, the combustion chamber was provided with wood chips and small pieces of waste. After combustion had got started, $CO_2$ content and soot factor were measured for different ratios of the mixture of fresh air and recirculated flue gases. The soot factor was graded according to a number scale between 0 and 9, the figure 0 signifying that no, or practically no, soot was to be found in the flue gases. The $CO_2$ content constituted a direct measure of the excess air, which theoretically is about 20% for wood fuel.

With the flap 22 closed in the return conduit 21 for recirculating flue gases, $CO_2$ contents of about 10% and soot factors of about 4 were measured. Only insignificant blue flames could be observed in the flame (as a result of local recirculation). After the flap 22 had been opened at least 15° and external recirculation of flue gases had come into effect, higher $CO_2$ contents were measured, although the soot factor was around 0 all the time. The proportion of blue flames continued to be at around at least 50%, simultaneously as a less flame height could be observed compared with the flame height for the previous case when no flue gases were recirculated. The blue flames were particularly intensive immediately around the gap 27 and occasionally over the fuel bed 28 also.

Similar trials were subsequently carried out with pellets, wood chips and peat as fuel, the same good results being obtained.

Figure 2:
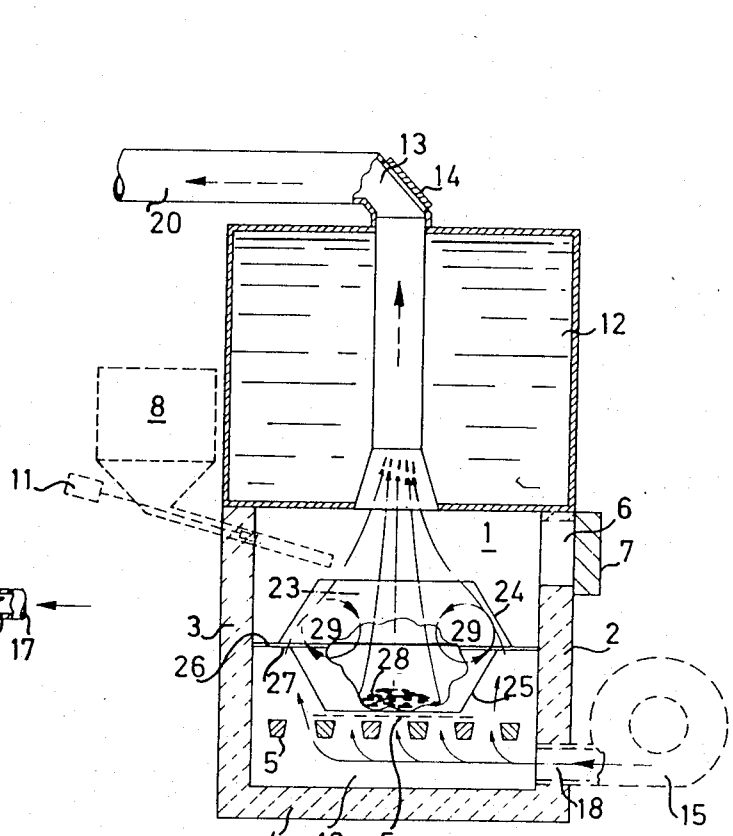
FIG. 2 illustrates a second such embodiment, solely having fresh air supply. Both figures are schematical vertical sections through the respective arrangement.

In the second embodiment of an arrangement in accordance with the invention and illustrated in FIG. 2, there is no external recirculation conduit (return conduit) 21 with associated valves 16,22 and the inlet conduit 17, as illustrated in the first embodiment of FIG. 1. Instead, fresh air is drawn in through the suction side of the fan 15 and is forced out through the supply conduit 18. The same sequence as described in conjunction with the embodiment in FIG. 1 is repeated for the fresh air-flue gas mixture, but with the difference that all blending of recirculating residue gases and fresh air now takes place entirely within the combustion space 23 and along the gap 27, which only lets through fresh air. The combustion above the fuel bed 28 thus has no primary aid from the heat energy of the residue gases and the catalytic action thereof, this help first occurring in the outer combustion zones, which affects to some small extent the composition and purity of the flue gases after combustion.

The fan 15 can even be omitted if its effect may be replaced by the chimney draught, i.e. if the subpressure provided by the chimney is sufficient for drawing in the amount of fresh air required for combustion then takes place in the described manner, but with reduced effect.

The invention is not limited to the embodiments described here and shown on the drawings, but may be modified in many ways within the scope of the claims.

I claim:

1. An improvement in a solid fuel combustion chamber in which the combustion gases are recirculated; comprising peripheral walls surrounding the combustion chamber, fire bars located in the lower part of the combustion chamber for supporting said fuel in the central area thereof; a convection section arranged above said chamber; a flue-gas outlet communicating with said chamber by means of said convection section; fan means for supplying combustion gases to the combustion chamber; and a supply conduit extending from the pressure side of the fan means and having an outlet located in the combustion chamber beneath the fire bars; wherein the improvement comprises an upwardly open first screening wall located above the fire bars in the combustion chamber, and in inwardly spaced relationship with the peripheral walls thereof, said first screening wall surrounding the central area upwardly adjacent the fire bars whereby gases delivered by the supply conduit discharging beneath the fire bars, and entering the combustion chamber through the fire bars, flow into both the space radially inward of said first screening wall and the space outward thereof; and a downwardly open second screening wall which is located substantially above the first screening wall, the inner peripheral surface of the lower opening of the second wall being disposed radially outward of, and adjacent to, the outer peripheral surface of the upper opening of the first screening wall, so as to define between said adjacent peripheral surfaces of said first and second screening walls a gap which encircles said central area upwardly adjacent the fire bars in the combustion chamber, and which provides a gas supply opening for gases entering the combustion chamber through the fire bars and flowing outwardly of the first screening wall, said gap communicating with the space located radially inwardly of both said screening walls, so as to direct the flow of gases entering said gap along the inner surface of the second screening wall to cool the latter and to further direct said gases into circulation with the gases inside the first screening wall emanating from the fire, thereby generating blue-frame combustion within said screening walls; and a baffle wall within said combustion chamber, extending radially from the periphery of the lower opening of the second screening wall to the surrounding wall of the combustion chamber to guide gases flowing externally of said first screening wall into said gap.

2. The improvement as in claim 1, further comprising:

air intake means connected to the suction side of said fan means; and return conduit means connected to the suction side of said fan means and to the flue-gas outlet, for recycling flue gas from the combustion chamber back to the fan means for re-entry into the combustion chamber via the fan means, whereby such gases supplied by said fan means are a mixture of air and flue gas.

3. The improvement as in claim 1, further comprising:

air intake means connected to the suction side of said fan means and communicating with the ambient atmosphere, whereby the gases supplied by said fan means are essentially air.

4. The improvement as in any one of claims 1, 2, or 3, characterized in that the first and second screening walls have the shape of the lateral surfaces of two truncated cones with their bases mutually opposed.

5. The improvement as in any one of claims 1, 2, or 3, characterized in that the first and second screening walls have the form of the lateral surfaces of two cylinders.

6. The improvement as in any one of claims 1, 2, or 3, characterized in that the first and second screening walls have the shape of the lateral surfaces of two truncated pyramids with their bases mutually opposed.

7. The improvement as in any one of claims 1, 2, or 3, chracterized in that arranged beneath the fire bars in the combustion chamber is an ash chamber which forms a distribution chamber for the gases supplied via said fan means.

8. The improvement as in claim 2, characterized in that control valves are arranged in the air intake means connected to the fan means and in the return conduit means for flue gases, to regulate the flow and composition of the gas mixture supplied to the combustion chamber via the fan means.

* * * * *